US005553865A

United States Patent [19]

Shoemaker, Jr. et al.

[11] Patent Number: 5,553,865

[45] Date of Patent: Sep. 10, 1996

[54] ROTARY PUSH ARCADE GAME

[75] Inventors: Stephen P. Shoemaker, Jr., 140 The Village #401, Redondo Beach, Calif. 90277; Joseph L. Tallerico, Livermore; Todd Schricker, Sunnyvale; Matthew F. Kelly, San Ramon; Bryan M. Kelly, Alamo, all of Calif.

[73] Assignee: Stephen P. Shoemaker, Redondo Beach, Calif.

[21] Appl. No.: 343,759

[22] Filed: Nov. 22, 1994

[51] Int. Cl.[6] ..... A63F 9/00

[52] U.S. Cl. ..... 273/448; 221/209; 108/20

[58] Field of Search ..... 273/447, 444; 221/209; 108/20, 139

[56] References Cited

U.S. PATENT DOCUMENTS

| | | | |
|---|---|---|---|
| 2,057,880 | 10/1936 | Collison et al. | 312/35 |
| 2,302,821 | 11/1942 | Walton | 312/35 |
| 2,890,088 | 6/1959 | Lepry et al. | 108/20 |
| 3,754,759 | 8/1973 | Breslow et al. | 273/1 R |
| 3,929,336 | 12/1975 | Breslow | 273/108 |
| 4,133,525 | 1/1979 | Balles et al. | 273/1 E |
| 4,590,351 | 5/1986 | Pomroy et al. | 108/20 X |
| 4,598,635 | 7/1986 | Clegg | 108/139 X |
| 4,714,249 | 12/1987 | Barlow | 273/1 G |
| 4,718,667 | 1/1988 | Shoemaker, Jr. | 273/448 |
| 4,726,585 | 2/1988 | Shoemaker, Jr. | 273/1 GC |
| 5,275,402 | 1/1994 | Malavazos et al. | 273/138 A |

FOREIGN PATENT DOCUMENTS

| | | | |
|---|---|---|---|
| 1177535 | 9/1964 | Germany | 273/448 |
| 441359 | 1/1936 | United Kingdom | 221/209 |

*Primary Examiner*—Paul E. Shapiro
*Attorney, Agent, or Firm*—Hickman Beyer & Weaver

[57] ABSTRACT

An improved rotary push arcade game including a turntable having a central aperture. Prize objects which are positioned on the surface of the turntable are moved by a pivoting arm member positioned above the turntable. An improved tip of the arm member is engaged with the surface of the turntable and is used to engage an object and push the object into a collection pocket. The collection pocket detects the presence of the object and provides the object to the player. An object dispenser which is positioned in the central aperture of the turntable is used for dispensing additional objects onto the surface of the turntable as required. A wheel mechanism coupled to the turntable near the edge of the turntable causes the turntable to rotate.

49 Claims, 8 Drawing Sheets

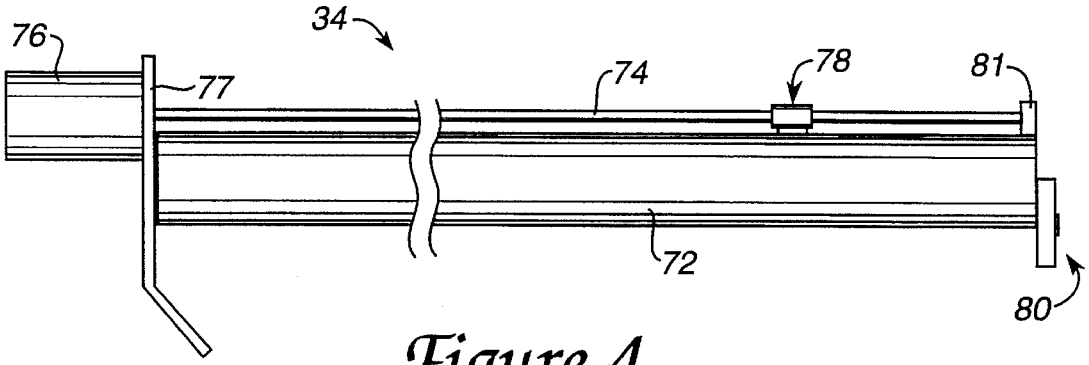
Figure 4
Figure 5a
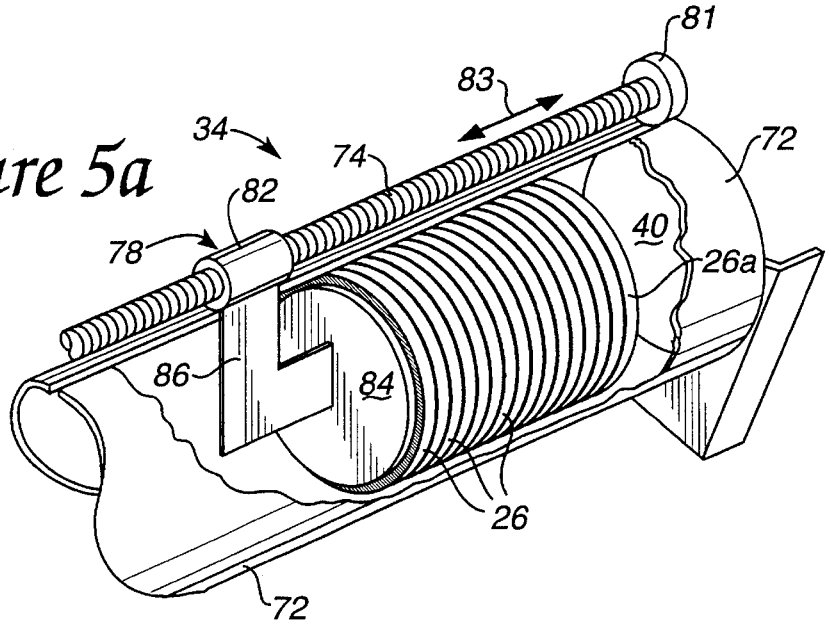
Figure 5b
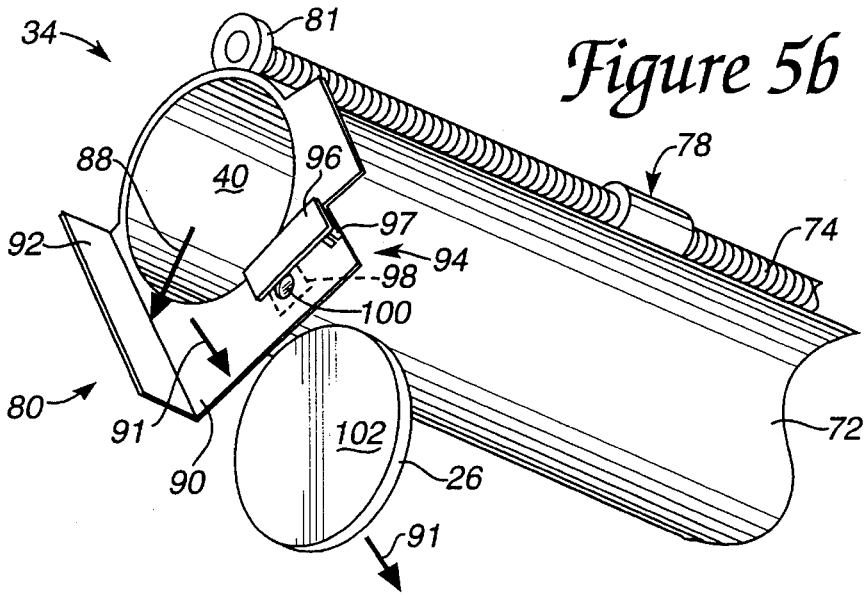

ROTARY PUSH ARCADE GAME

BACKGROUND OF THE INVENTION

1. Field of the Invention

This invention relates to games normally played in an arcade environment, and more particularly to such games played by using a pusher to move objects from a moving display surface.

2. Background of the Related Art

Games of many types are played in arcade environments. One type of game is a rotary push game which utilizes a display surface having a number of prizes or other objects displayed thereon. A player uses a push mechanism to physically move one or more objects along the surface and off the surface into a collection device. The player receives the object(s) he or she pushed off the display surface. A vending machine uses a similar concept to distribute items to a buyer.

An example of a rotary push game is found in U.S. Pat. No. 4,133,525, of Balles et al., which describes a game having a rotating plane member which has objects placed upon it. An arm member is rotatably maneuverable by a player across a portion of the plane member. By coordinating the movement of the arm member in an arc above the plane member with the rotation of the plane member, a player can dislodgè objects from the rotating member.

Another example is found in U.S. Pat. No. 4,714,249, of Barlow, which describes a game having a rotatable disk located in an enclosed housing. A number of objects are placed on the rotating disk, each object having a specific color. A player manipulates a rotatable arm member over the disk to catch objects of a certain color and place the objects in a pocket.

Yet another example is found in U.S. Pat. No. 2,057,880, of E. E. Collison et al., which describes a vending machine having a turntable with a central opening. A boom is used to move specific objects into the opening to be dispensed to a buyer.

The rotary push games of the prior art, while enjoyable, are limited when dispensing objects onto the display surface. The automatic dispensing apparatus of the prior art typically does not distribute objects onto the playing surface in an even, predictable manner and desired orientation. This can be a disadvantage when an object includes designs or markings on only one side of the object which are intended to be displayed to players of the game. In addition, flat or short objects are not reliably moved with the push arms of the prior art. This is because many prior art push games have push arm tips which are separated from the display surface to avoid wear of the tip and the surface, and therefore cannot engage flat or short objects. These limitations can be undesirable for a rotary push game offering flat or low-profile objects which should be dispensed and presented in a predictable distribution and orientation.

SUMMARY OF INVENTION

The present invention provides an improved rotary push arcade game and method for playing a push game with flat objects. In the present invention, an arm member engages a rotating member by physically touching its surface with the tip of the arm member. The arm member can be moved to guide an object off the surface to a collection pocket, which delivers the object to the player. The present invention includes a central dispensing mechanism which dispenses the objects on the rotating surface in a distributed, predetermined orientation. These improvements allow a greater variety of types of objects to be consistently presented to the player.

A game apparatus of the present invention includes a rotating member, such as a turntable, having a surface and a central aperture. Objects are positioned on the surface of the turntable to be viewed by a player. A movable arm member positioned above the turntable has a tip engaged with the surface of the turntable. The arm member can be moved across the turntable to force an object off the turntable by engaging the object with the tip of the arm member and pushing the object. A collector is also included for collecting the object when the object has been forced off of the turntable by the arm member. Finally, an object dispenser is used for dispensing additional objects onto the surface of the turntable. The object dispenser is positioned in the central aperture of the turntable.

A turntable driving mechanism is coupled proximate to an outside edge of the turntable for causing the turntable to rotate. The turntable driving mechanism preferably includes a number of wheels supporting the outside edge of the turntable. At least one of the wheels is rotated by a motor to rotate the turntable. The object dispenser preferably includes an elongated tube for holding the objects, a pusher element for dispensing the objects onto the turntable, and a sensor which detects the number of objects dispensed. The object dispenser also includes a guide which guides objects onto the turntable so that the objects land in a predetermined (e.g., face-up) orientation. The tip of the moveable arm member includes a tip cover which engages the turntable and is loosely attached to the end of the arm member. When the tip cover loses material at its point of contact with the turntable over prolonged use, the tip cover slides down the end of the arm member to remain engaged with the turntable. The movement of the arm member is preferably constrained to an arc over the turntable, where an arm motor causes the arm member to pivot. The arm member has a starting position near a center of the turntable, and is constrained in a direction towards the outer edge of the turntable during game play. The collection device includes a sensor for detecting when an object is moved off the turntable and guides the collected objects to a player.

A method for operating an arcade game in accordance with the present invention provides an arm member to engage a rotating surface and a number of substantially flat objects positioned on the rotating surface. The arm member can be controlled by a player to be pivoted in an arc over the rotating surface to push a first flat object on the rotating surface into a collector. The first flat object is provided to a player from the collector. Finally, a second flat object is dispensed in a predetermined orientation onto the rotating surface from a center opening in the rotating surface when the first flat object is received by the collector. The first flat object is detected when it fails into the collector, and the second flat object is detected when it is dispensed. The rotating surface is rotated by engaging an outer edge of the surface with a wheel driven by a motor. The arm member is pivoted by a motor from a start position to an end position on the rotating surface during game play. After the arm member reaches the end positon, it is preferably rotated from the end position back to the starting position.

An advantage of the present invention is that a dispenser positioned in the center of a rotating turntable provides objects in an even, distributed manner. Furthermore, the dispensed objects are provided in a predetermined orientation. For example, a particular side of the object is oriented facing up from the turntable. This is desirable for objects which have only one side printed with a design or other markings intended to be displayed to players of the game.

Another advantage of the present invention is that the arm member tip which engages the turntable does not adversely affect game play after becoming worn with prolonged use. Flat or short prize objects can thus be provided to players of the game.

These and other advantages of the present invention will become apparent to those skilled in the art after reading the following descriptions and studying the various figures of the drawings.

BRIEF DESCRIPTION OF THE DRAWINGS

FIG. 4 is a side view of the dispenser of the present invention;

FIG. 5*a* is a partial perspective view of the interior mechanism of the dispenser shown in FIG. 4;

FIG. 5*b* is a partial perspective view of the sensor on the dispenser shown in FIG. 4;

DETAILED DESCRIPTION OF THE PREFERRED EMBODIMENTS

Figure 1:
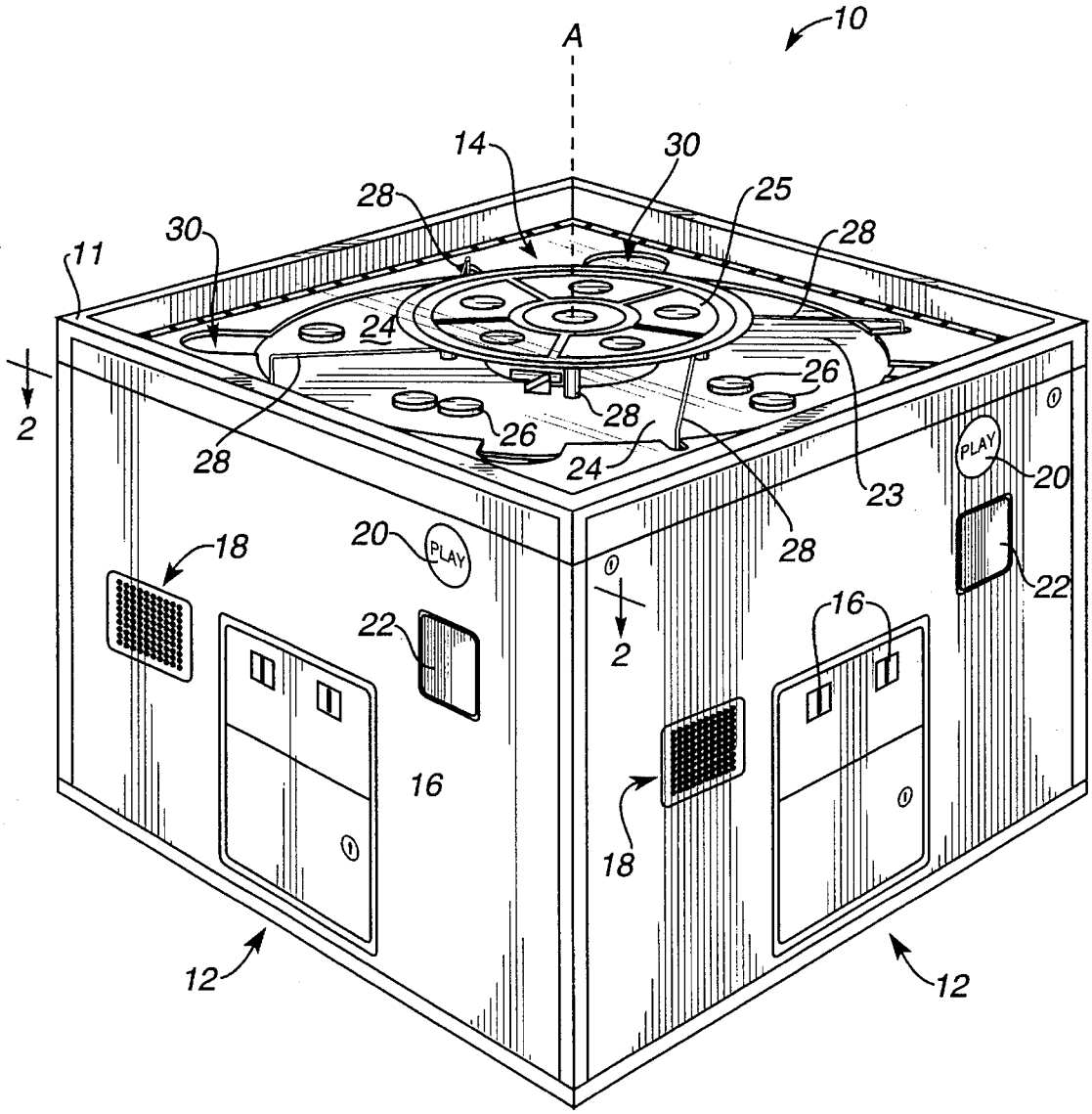
FIG. 1 is a perspective view of a game apparatus of the present invention.

FIG. 1 is a perspective view of a game apparatus in accordance with the present invention. The game apparatus 10 includes panel sections 12 and a playing area 14.

In the described embodiment, there are four panel sections 12 provided around the exterior of the game apparatus 10 forming the sides of the apparatus. The panels are supported by a frame 11. A player can operate the game apparatus from any panel section 12, or multiple players can operate the game simultaneously, each player using a different panel section 12. Alternatively, a one-player version of game apparatus 10 can be provided having only one panel section 12, a two-player version can have two panel sections, etc. Panel sections 12 each include a coin deposit slot 16, a speaker 18, a play button 20, and a dispensing aperture 22.

Coin deposit slot 16 may accept standard currency coins or game tokens that are often available in an arcade environment. Coins deposited in coin deposit slot 18 are stored in a coin box positioned behind the panel section 12 (shown in FIG. 3). In the described embodiment, a game begins after a coin has been inserted in slot 16.

The speaker 18 emits sounds based on game actions and other game states and is controlled by the game unit controller system. The operation of the speaker will be discussed in greater detail subsequently.

Play button 20 is used by the player to control game action. In the described embodiment, the player pushes the play button to control the sweep of an arm member used to guide objects into a collection pocket. In alternate embodiments, different or additional player controls can be provided. For example, a joystick can be used to control an arm member, or further controls can be added to move arm members in specific directions or even to open the collection pockets as prizes are guided into them. Such controls are well known to those skilled in the art.

Dispensing aperture 22 preferably dispenses any prize objects won by the player in playing area 14 of the game apparatus. In this described embodiment, the objects which are guided off the playing field by the player are collected and dispensed directly to the player in dispensing aperture 22. The dispensing aperture is an aperture provided in panel section 12 which preferably allows dispensed objects to be removed by the player but prevents access to the interior of the chamber by a player inserting his hand in the dispensing aperture, etc. In alternate embodiments, dispensing aperture 22 or a different type of dispenser can dispense other types of awards based on a game score achieved by the player or based on the performance of the player in playing area 14. For example, a number of tickets can be dispensed based on how many objects the player guided off the playing field or a score the player reached (a game score display can also be provided on panel section 12). Similarly, baseball or other sports cards can be dispensed, or even coins or currency. Ticket dispensing mechanisms are well-known in the prior art. In such an embodiment, the awards can be stored in a storage area behind panel section 12. In yet other embodiments, dispensing aperture 22 is not used, and a player views a game score display to evaluate his or her performance.

Playing area 14 provides game action and game results to the player of game apparatus 10. In the preferred embodiment, playing area 14 is covered by a transparent, protective covering 23 which prevents players from tampering with game action or mechanisms in playing area 14. Playing area 14 includes a turntable 24, prize objects 26, arm members 28, and collection pockets 30.

Turntable 24 is preferably a rotatable, substantially circular member such as a disc or cylinder, although, in alternate embodiments, other types and shapes of moving members can be used, such as a conveyor belt. Turntable 24 rotates about a central axis A using a turntable driving mechanism, explained in greater detail with respect to FIG. 3. As shown in FIG. 1, a cover 25 is positioned over the central region of turntable 24. This cover is used for decorative purposes and is also used to hide the dispensing mechanism which dispenses objects on turntable 24. The dispensing mechanism is described in greater detail with respect to FIG. 2.

Prize objects 26 are objects that are placed and dispensed onto turntable 24 to be viewed by one or more players. In the described embodiment, objects 26 are flat, substantially circular objects, such as the currently popular cardboard milk bottle caps knows as "POGS." Other types of objects can be used as well, including coins, tokens, cards, tickets, or similar objects. The objects 26 described herein are flat, low-profile objects, since the arm member moving mechanism of the present invention is specially designed to push or move such objects. Objects 26 can be less than one-fourth of an inch in height, and are preferably less than one-eighth of an inch in height. In a described embodiment, about 70 objects are placed and displayed on turntable 24 at one time. This number of objects, however, can vary widely depending on the size of the objects, size of the turntable, size of the arm members, desired difficulty level of the game, etc.

Arm members 28 are movable members which are controlled by the player to move objects 26 off of turntable 24. In the described embodiment, arm members 28 are thin horizontal rods which are positioned over turntable 24. A vertical end portion of each arm member is coupled to a motor near the outer perimeter of game apparatus 10, and another vertical end portion of each arm member engages turntable 24 at its tip by resting on the top surface of turntable 24 (described in greater detail with respect to in FIG. 9). When a player pushes play button 20, arm member 28 is pivoted by a motor so that its engaging tip moves from the inner edge of the turntable towards the outer perimeter of the turntable. By guiding arm member 28 when prizes 26 are rotated into the path of the arm member, a player can engage and push objects 26 toward collection pockets 30 with the arm member.

Collection pockets 30 include apertures in playing area 14 provided along the edges of turntable 24. Using arm members 28, a player can guide objects 26 into the collection pockets, where the objects are routed to dispensing aperture 22 of panel section 12. The player can then retrieve the objects he or she was able to guide off the turntable.

In an alternate embodiment, a player can guide an object into a collection pocket 30 as described above, except that the player does not receive the object. Instead, a different award such as tickets, cards, etc. can be dispensed, and/or a score can be increased and displayed to the player.

Figure 2:
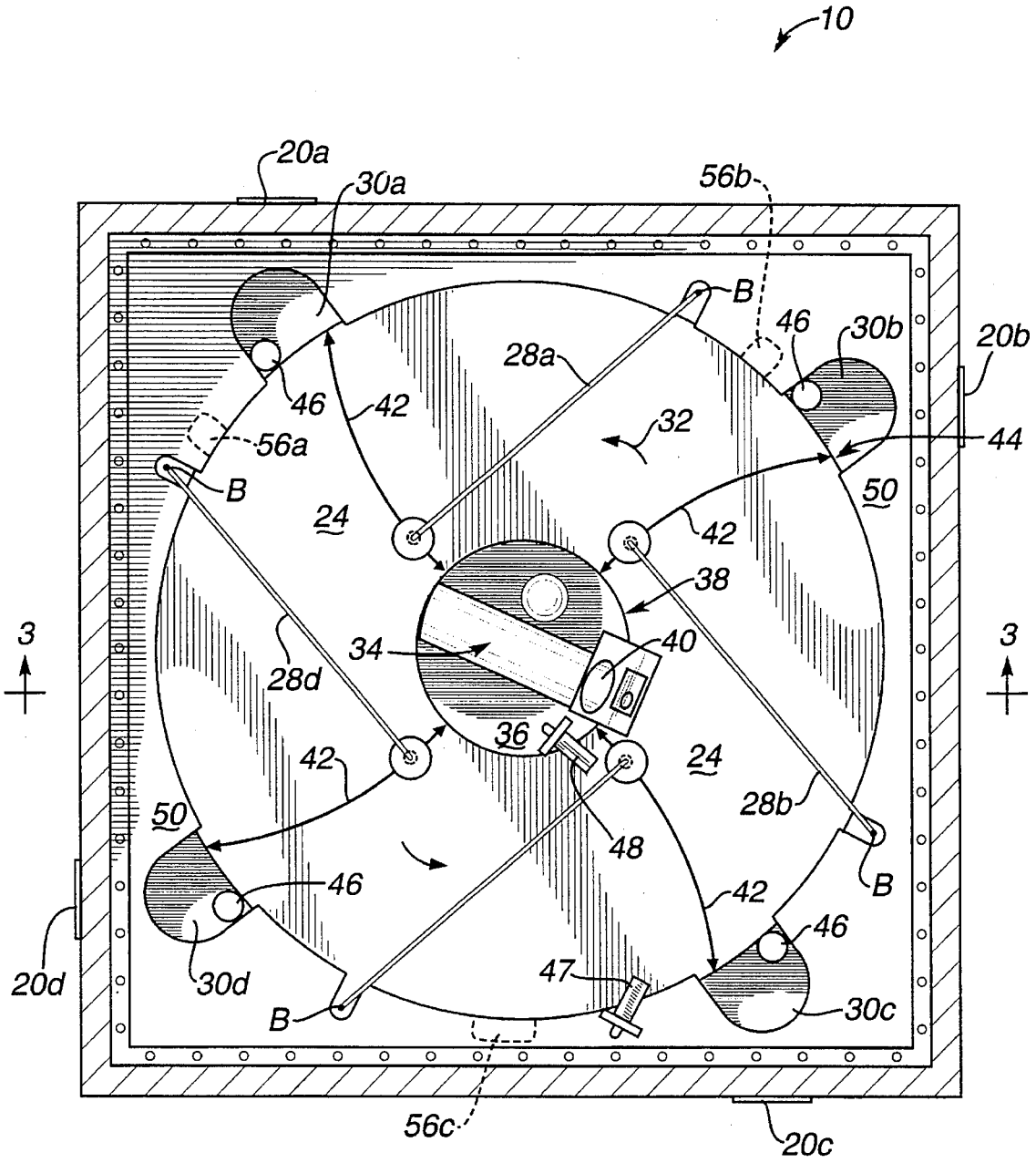
FIG. 2 is a top cross-sectional view taken along line 2—2 of FIG. 1.

FIG. 2 is a cross sectional top plan view of game apparatus 10 taken along line 2—2 of FIG. 1. Rotating surface 24 rotates in a counterclockwise direction as shown with arrows 32 in the example of FIG. 2. Alternatively, rotating surface 24 can be made to rotate in a clockwise direction. Rotating surface is supported and rotated using wheel mechanisms 56*a*, 56*b*, and 56*c*, which are described in greater detail with reference to FIG. 3.

Dispenser 34 is shown protruding through a center opening 36 in rotating surface 24. In the described embodiment, dispenser 34 is an elongated, hollow tube which stores the flat objects used as prize objects 26, such as milk bottle caps. Dispenser 34 is coupled to frame 11 at one end beneath rotating surface 24 and protrudes through the center opening 36 such that the other end of the dispenser rests on the rotating surface near inner edge 38. Objects 26 are dispensed from front opening 40 in dispenser 34 onto rotating surface 24. The center location of dispenser 34 allows objects to be dispensed in a distributed manner from the center of the turntable. As players attempt to move the objects closer to the turntable's outer edge 44 during game play, the objects become more distributed over the surface of the turntable. Dispenser 34 is described in greater detail with reference to FIG. 4. In the described embodiment, as objects are guided off the turntable, dispenser 34 dispenses more objects to keep the number of objects on the turntable approximately constant.

In the described embodiment, each arm member 28 pivots around an axis B positioned outside the outer edge 44 of turntable 24. The arm members are thus limited to a particular arc of movement over turntable 24 as shown by arrows 42. Each arm member 28 can push or guide an object 26 only substantially along the arc 42 and into an associated collection pocket 30. Thus, arm member 28*a* is associated with collection pocket 30*a*, arm member 28*b* with collection pocket 30*b*, arm member 28*c* with collection pocket 30*c*, and arm member 28*d* with collection pocket 30*d*. The mechanism to move the arm member and guiding objects to the collection pockets is described in greater detail with respect to FIG. 3.

Each collection pocket 30*a*–*d* is provided along the path of an associated arm member, as described above. Each collection pocket 30*a*–*d* also includes an outer edge guide 46. Outer edge guide 46 is an upright member, preferably cylindrical, which is close to the outer edge 44 of turntable 24. Guide 46 is preferably positioned on the edge of the collection pocket 30 that is further along the direction of rotation. Outer edge guide 46 serves to guide any objects 26 which may be partially positioned over the outer edge 44 of turntable 24. Thus, if a player controls an arm member 28 such that an object 26 is moved to outer edge 44 but does not enter the collection pocket, the object may be hanging over the edge and may fall off turntable 24 in a different, undesired location in playing area 14. If such an object rotates into guide 46, the guide pushes the object toward inner edge 38 and fully back onto turntable 24. Extended outer edge guide 47 is another guide which is positioned near outer edge 44 of turntable 24. Extended guide 47 extends over turntable 24 for about an inch to push inward any objects 26 which are close to the outer edge 44. Extended guide 47 operates similarly to guides 46 except that objects are forced a greater distance towards inner edge 38.

Inner edge guide 48 is an angled member in contact with the surface of turntable 24 which provides a similar function to that of extended outer edge guide 47. Objects 26 which are dispensed from dispenser 34 must be moved closer to outer edge 44 so that arm members 28 are able to move them and so that additional objects from dispenser 34 will not be dispensed on top of previously dispensed objects. Also, dispensed objects may occasionally move toward inner edge 38 or push another object towards inner edge 38. Any objects which get too close to the inner edge cannot easily be guided with arm members 28 to collection pocket 30. Thus, inner edge guide 48 pushes any objects 26 which are too close to the inner edge by imparting a force on the object away from the inner edge as rotating surface 24 moves the object into contact with guide 48 in the direction of turntable rotation.

Preferably, turntable 24 is positioned at a lower height than an upper plane member 50 which extends around the perimeter of the turntable. Upper plane member 50 includes apertures at the locations of collection pockets 30 and the ends of arm members 28 not engaged with turntable 24.

Figure 3:
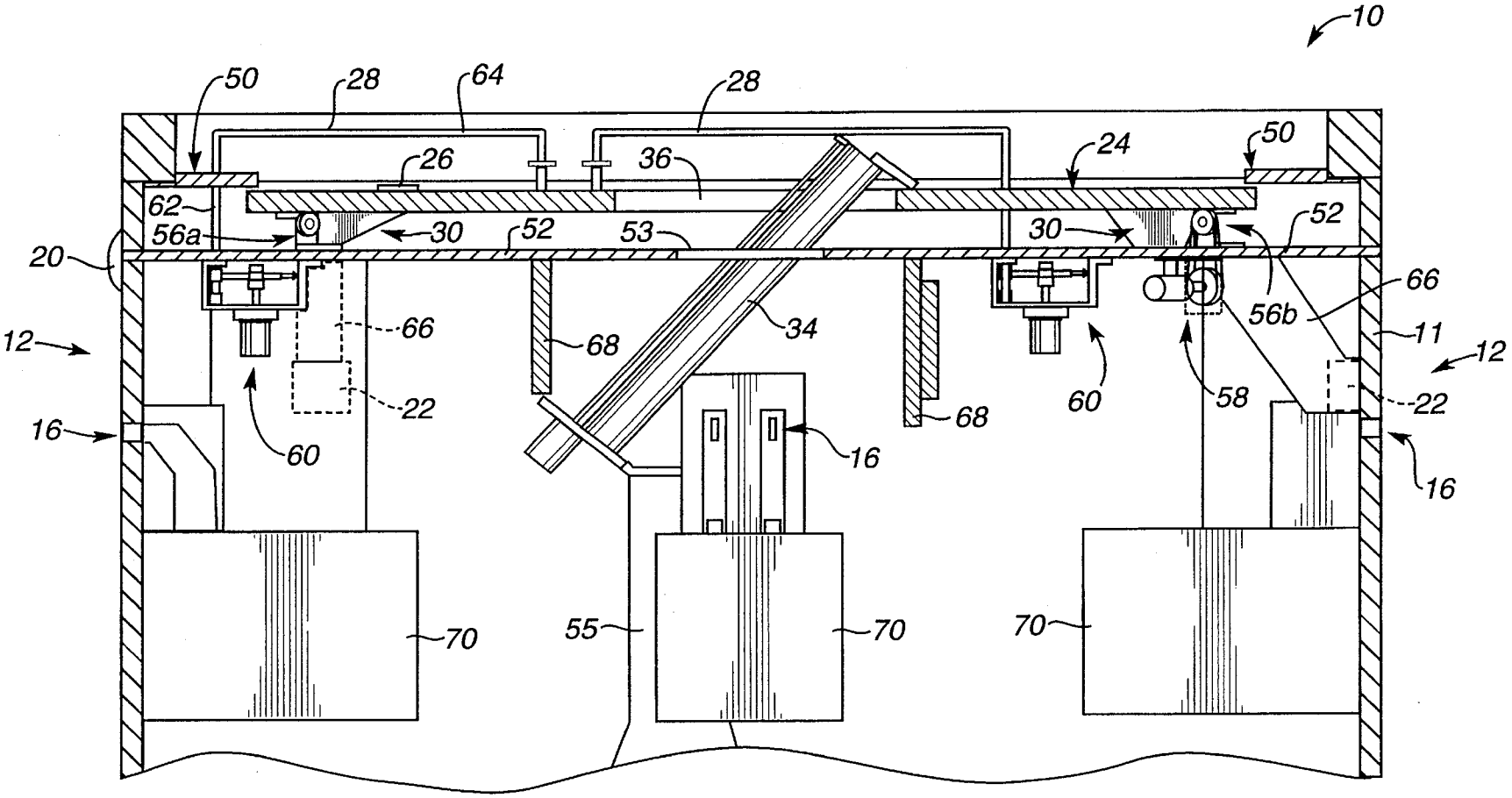
FIG. 3 is a partial side cross-sectional view taken along line 3—3 of FIG. 2.

FIG. 3 is side cross sectional view of a portion of game apparatus 10 taken along line 3—3 of FIGS. 1 and 2. Turntable 24 is positioned beneath upper plane member 50 and above a lower plane member 52. Lower plane member 52 is coupled to frame 11 and includes a central aperture 53 through which dispenser 34 extends. Dispenser 34 is coupled to a support 55 which is located beneath lower plane member 52.

Rotating surface 24 is supported above lower plane member 52 by a number of wheel mechanisms 56, which collectively can be referred to as a turntable driving mechanism. In the described embodiment, three wheel mechanisms are used: guiding wheel mechanism 56*a*, drive wheel mechanism 56*b*, and a spring wheel mechanism 56*c* (shown in FIGS. 2 and 8). Each wheel mechanism provides a vertically aligned wheel whose edge engages the bottom surface of turntable 24 to allow the turntable to rotate, and a horizontally aligned wheel whose edge engages the edge of turntable 24 to prevent the turntable from moving laterally. Drive wheel mechanism 56*b* is coupled to a motor assembly 58 which is coupled to the bottom surface of lower plane member 52. Wheel mechanisms 56*a*, 56*b*, and 56*c* are described in greater detail in FIGS. 6, 7, and 8, respectively.

Arm members 28 are provided over turntable 24 and are each coupled to an arm drive mechanism 60 that is coupled to the bottom surface of lower plane member 52. In the described embodiment, arm drive mechanism 60 rotates the vertical end portion 62 of an arm member 28, which causes the horizontal portion 64 to pivot along the arc 42 shown in FIG. 2. Arm drive mechanism 60 is described in greater detail with respect to FIG. 10.

Collection pockets 30 are shown positioned under turntable 24 and are coupled to lower plane member 52. Pockets 30 collect any objects 26 which have fallen off of turntable 24 and route the objects to dispensing aperture 22 via chute 66, as described in greater detail with respect to FIG. 11.

Several components of game apparatus 10 are located under lower plane member 52. Members 68 can be used to support control circuitry which is coupled to components such as arm drive mechanism 60, wheel drive mechanism 56*b*, and dispenser 34. In other embodiments, the control circuitry can be positioned on the bottom side of lower plane member 52, on side walls of frame 11, etc. Control circuitry for the present invention is described in greater detail with reference to FIG. 12.

Coin slot 16 guides a coin inserted by a player into a coin box 70. Mechanisms for guiding, detecting, and storing coins or tokens are well known to those skilled in the art. In the described embodiment, each panel section 12 of game apparatus 10 includes an associated coin box 70 for storing coins inserted into the coin slot 16 of that panel section.

FIG. 4 is a side elevational view of dispenser 34. Dispenser 34 includes a housing 72, a screw shaft 74, a motor 76, a push assembly 78, and a dispensing guide 80.

The housing 72 is, in the described embodiment, a cylindrical housing which holds circular objects 26. For example, milk bottle caps or other coin-shaped objects can be stacked in housing 72. Alternatively, housing 72 can be shaped in a different way (a cross-section shaped like a square, octagon, triangle, etc.) to accommodate objects of different shapes.

Dispenser motor 76 is coupled to housing 72 by a support plate 77. One end of screw shaft 74 is coupled to a rotating spindle of the motor 76. The other end of screw shaft 74 is coupled to a circular end support 81 such that screw shaft 74 can rotate freely.

Push assembly 78 is coupled to screw shaft 74 such that assembly 78 moves when screw shaft 74 is rotated. Push assembly 78 is described in greater detail with respect to FIG. 5*a*. Dispensing guide 80 is positioned on the dispensing end of dispenser 34 and is used to guide a dispensed object onto turntable 24 in a predetermined orientation. Dispensing guide 80 is described in greater detail with respect to FIG. 5*b*.

FIG. 5*a* is a partial perspective view of the dispensing end of dispenser 34. Push assembly 78 includes a nut 82 engaged with screw shaft 74 such that when screw shaft 74 is rotated about its central axis, push assembly 78 translates along the central axis of the screw shaft as indicated by arrow 83. Push assembly 78 also includes a push plate 84 which is coupled to nut 82 by a support arm 86. When screw shaft 74 is rotated in a direction to translate nut 82 towards the front opening 40 of the dispenser by turning on motor 76, push plate 84 is also moved and forces objects 26 supported by housing 72 towards front opening 40. The front object 26*a* first falls out of front opening 40 and, if appropriate, dispenser motor 76 is turned off so that only one object is dispensed (more objects may also be dispensed before turning off motor 76). When additional objects are to be dispensed, the motor is again activated until the desired objects are dispensed. Similarly, if it is desired to move push assembly 78 in the opposite direction (away from front opening 40) such as, for example, to load an empty dispenser 34 with more objects 26, then screw shaft 74 is rotated by dispenser motor 76 in the opposite direction to the direction used to move assembly 78 towards front opening 40.

FIG. 5*b* is a partial perspective view of the front opening 40 and dispensing guide 80 of dispenser 34. An object 26 is typically pushed in housing 72 toward front opening 40 enough so that it falls out of the opening; since dispenser 34 is angled as shown in FIG. 3, gravity propels object 26 in a direction shown by arrow 88. Dispensing guide 80 includes a face plate 90 and a guide wall 92. A sensor 94 is positioned on face plate 90 to detect any object 26 which is dispensed from dispenser 34. In the described embodiment, sensor 94 includes an emitter 96 and a detector 98. Emitter 96 is supported by small supports 97 which position the emitter above the face plate 90 so that an object 26 can slide between the emitter and the face plate 90. Detector 98 is positioned on the opposite side of face plate 90 and is aligned with a hole 100 in face plate 90. Emitter 96 preferably emits a beam of electromagnetic energy, such as infrared light, through hole 100 in face plate 90 and at detector 98. Detector 98 is continually detecting the beam emitted from emitter 96. Such emitters and detectors are well known to those skilled in the art.

When an object 26 is pushed from housing 72 and slides down face plate 90, the object typically collides with guide wall 92, which guides the object along a pathway underneath emitter 96 in a direction indicated by arrow 91. When object 26 slides under emitter 96, the beam from the emitter is broken. Detector 98 no longer detects the beam and sends a signal out to the microprocessor (detailed with respect to FIG. 12) indicating that an object has been dispensed.

Other types of sensors can be used in place of the emitter-detector sensor 94. For example, a mechanical switch can be placed on face plate 90 which is closed when an object is dispensed. Or, magnetic sensors which can sense the presence of a metallic object 26 can be used.

The object 26 which slides down face plate 90 in a direction 91 impacts turntable 24 after a short distance. Due to the angle of the face plate with respect to the surface of the turntable, object 26 typically will land with a known side 102 facing up away from the turntable towards a player. This feature of dispenser 34 can be useful when dispensing objects which are desired to land in a specific orientation. For example, prize objects such as milk bottle caps typically have only one side of the bottle cap printed with designs, pictures, etc. The printed side should be facing up when the cap is dispensed so the players can view the design on the cap and decide if they would like to obtain it. A player can thus look for a specific cap (and design) on the turntable that they want to guide into a collection pocket 30, adding to the appeal of the game.

Figure 6:
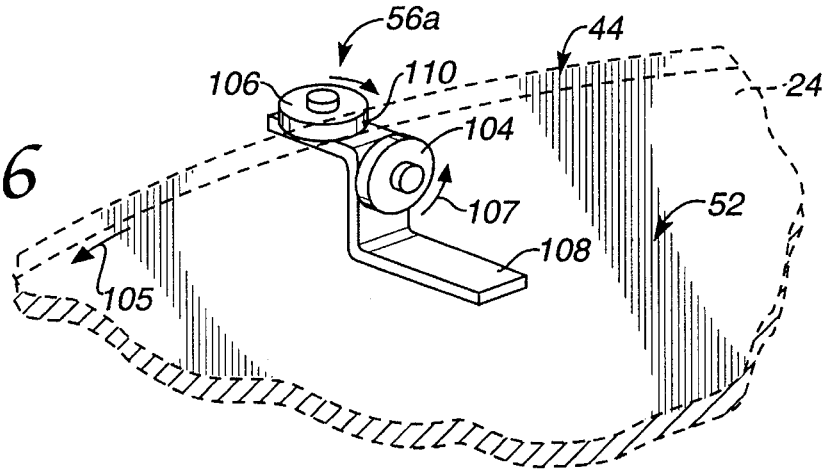
FIG. 6 is a perspective view of a first edge rotation mechanism used in the present invention.

FIG. 6 is a perspective view of wheel mechanism 56*a* used to help support turntable 24. Wheel mechanism 56*a* includes a vertical wheel 104, a horizontal wheel 106, and a support member 108. Base member 108 is coupled to the top surface of lower plane member 52 of game apparatus 10 beneath turntable 24. Vertical wheel 104 is coupled to a vertical side of base member 108 and is positioned such that the bottom surface of turntable 24, preferably near its outer edge 44, rests on the edge of wheel 104. When turntable 24 rotates, wheel 104 spins with the turntable. For example, as turntable rotates in a direction indicated by arrow 105, vertical wheel 104 spins in the direction indicated by arrow 107.

Horizontal wheel 106 is coupled to a substantially horizontal portion of base member 108. Wheel 106 is positioned such that the outer edge 44 of turntable 24 contacts the edge 110 of the wheel. Horizontal wheel 106 spins freely, permitting turntable 24 to rotate as well. Wheel 106 prevents turntable 24 from moving in a lateral direction towards wheel 106.

Figure 7:
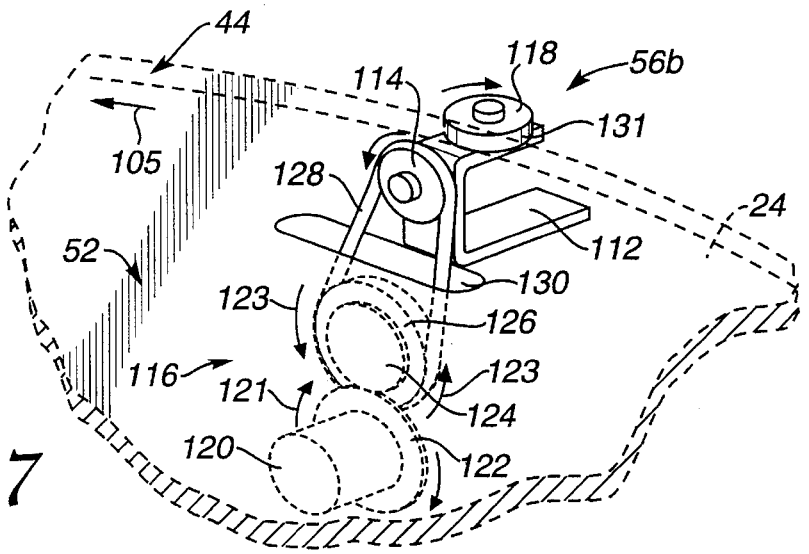
FIG. 7 is a perspective view of a second edge rotation mechanism used in the present invention.

FIG. 7 is a perspective view of drive wheel mechanism 56*b* used to both support and rotate turntable 24. Drive wheel mechanism 56*b* includes a base member 112, a vertical wheel 114, a motor assembly 116, and a horizontal wheel 118. Similar to wheel mechanism 56*a*, base 112 of drive wheel mechanism 56*b* is coupled to the top surface of lower plane member 52 beneath turntable 24. Vertical wheel 114 is coupled to a vertical surface of base support 112 and is positioned such that turntable 24 rests on the edge of wheel 114. In the preferred embodiment, vertical wheel 114 engages the bottom surface of turntable 24 near the outer edge 44. In alternate embodiments, vertical wheel 114 can be positioned closer to the center of the turntable. Any position from outer edge 44 to half a radius of the turntable is preferred, although vertical wheel 114 can engage turntable 24 at any point outside the center point (at axis A) of the turntable in other embodiments. The vertical wheels of wheel mechanism 56*a* and spring wheel mechanism 56*c* can be positioned similarly.

Motor assembly 116 is coupled to the bottom surface of lower plane member 52 as shown in FIG. 3 and includes a motor 120, motor gear 122, pulley gear 124, and a pulley 126. Motor 120 rotates motor gear 122, which is interlocked with pulley gear 124. Pulley gear 124 is coupled to pulley 126, and pulley 126 is coupled to vertical wheel 114 by a belt 128 which is routed through a hole 130 in lower plane member 52. When motor 120 spins motor gear 122 in the direction, for example, shown by arrow 121, pulley gear 124 and pulley 126 rotate in the opposite direction (shown by arrow 123). The rotation of pulley 126 rotates vertical wheel 114 in the same direction, and, since the bottom surface of turntable 24 is engaged with the edge of wheel 114, turntable 24 is caused to rotate in the direction indicated by arrow 105. Preferably, pulley 126 is coupled with sufficient tension to belt 128 to rotate turntable 24, yet is loose enough to provide a slip mechanism so that pulley 126 will slip if outside force is applied to turntable 24 in the opposite direction of rotation.

Drive wheel mechanism 56*b* also includes a horizontal wheel 118. Similar to the horizontal wheel of wheel mechanism 56*a*, horizontal wheel 118 is coupled to a horizontal surface of base member 112 and is positioned such that outer edge 44 of turntable 24 engages edge 131 of wheel 118. Horizontal wheel 118 prevents turntable 24 from moving laterally in the direction of wheel 118.

Figure 8:
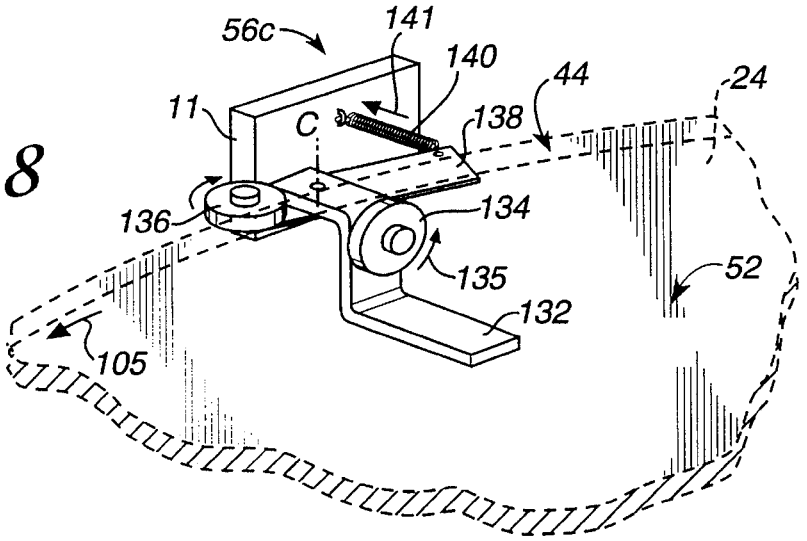
FIG. 8 is a perspective view of a third edge rotation mechanism used in the present invention.

FIG. 8 is a perspective view of spring wheel mechanism 56*c* used to support turntable 24. Spring wheel mechanism 56*c* includes a base support 132, a vertical wheel 134, a horizontal wheel 136, a pivoting member 138, and a spring member 140. Similar to the wheel mechanisms described in FIGS. 6 and 7, base support 132 is coupled to lower plane member 52 beneath turntable 24. Vertical wheel 134 is coupled to a vertical surface of base member 132 and is positioned such that the bottom surface of turntable 24, preferably near the outer edge 44, rests on the edge of wheel 134. Thus, for example, when turntable 24 rotates in the direction indicated by arrow 105, vertical wheel 134 rotates in the direction indicated by arrow 135.

Spring wheel mechanism 56*c* also includes horizontal wheel 136 which is coupled to one end of pivot member 138. Pivot member 138 is coupled to a horizontal portion of base member 132 such that it may pivot about an axis C. The other end of pivot member 138 is coupled to one end of spring member 140. The other end of spring member 140 is coupled to frame 11 of game apparatus 10, or a structure or member which is connected to frame 11. Horizontal wheel 136 is positioned such that the edge of wheel 136 engages the outer edge 44 of turntable 24. When turntable 24 rotates, for example, in the direction of arrow 105, then horizontal wheel 136 also rotates.

Horizontal wheel 136 prevents turntable 24 from moving laterally toward wheel 136. Pivot member 138 and spring member 140 allow the turntable to be tightly secured by the horizontal wheels of all three wheel mechanisms 56*a*, 56*b*, and 56*c*. Since horizontal wheel 106 of wheel mechanism 56*a* and horizontal wheel 118 of wheel mechanism 56*b* are fixed in place on their base members, horizontal wheel 136 is allowed to move away from edge 44 on pivot member 138. Spring member 140 pulls one end of pivot member 138 in a direction indicated by arrow 141, which in turn forces wheel 136 toward edge 44 and tightly secures turntable 24 in place.

Figure 9:
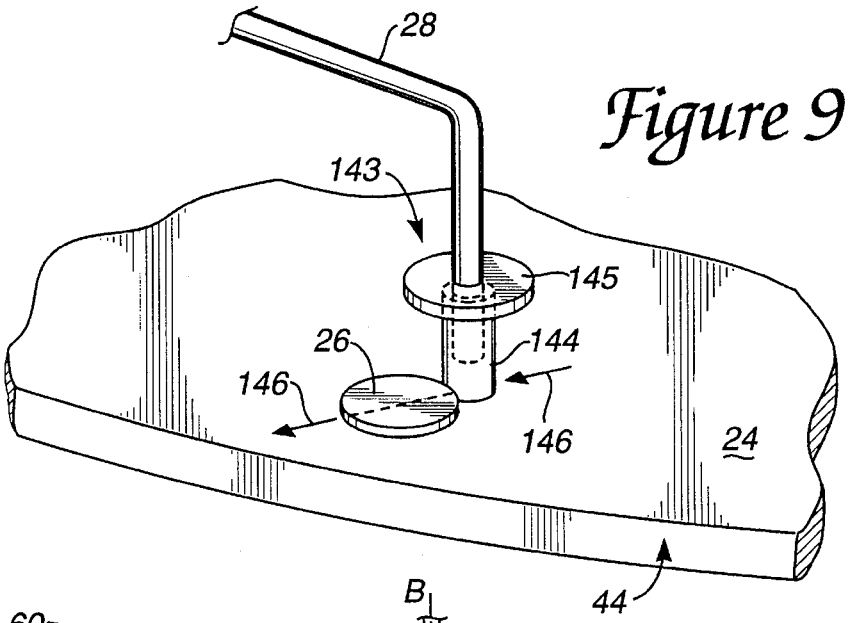
FIG. 9 is a perspective view showing an arm member of the present invention pushing an object.

FIG. 9 is a perspective diagram showing the tip 143 of an arm member 28 on the surface of turntable 24. Tip 143 includes a engaging tip cover 144 which contacts the surface of turntable 24 and a cover weight 145 positioned over tip cover 144. When arm member 28 is pivoted by arm drive mechanism 60, tip cover 144 moves across the surface of turntable 24, for example, in the direction indicated by arrow 146. If one or more objects 26 are in the path of tip cover 144, the object is pushed along the surface of turntable 24 until either the object is moved out of the path of the arm member or the outer edge of the turntable is reached and the object fails into collection pocket 30.

Tip cover 144 directly contacts the surface of turntable 24 so that flat or low-profile objects, such as milk bottle caps, can be pushed and so that the tip cover will not move over the object. Due to the direct contact with the turntable, tip cover 144 may become worn down at the point of contact or may collect dust or other particles from use. Tip cover 144 is thus preferably attached to arm member 28 loosely, so that when tip cover 144 becomes worn at the point of contact or collects particles on its end, the tip cover will be forced down arm member 28 due to the weight of cover weight 145 and gravity (weight 145 is also loosely attached to arm member 28). Tip cover 144 thus remains in contact with turntable 24 even after being worn down. If tip cover 144 has built up soot or dust from use, cover weight 145 forces the tip cover into a strong contact with turntable 24 so that objects 26 can be pushed. Suitable materials for tip cover 144 are nylon, Teflon, and other materials that have a relatively low coefficient of friction yet are relatively strong and durable. Cover weight 145 is preferably a heavy material, such as a metal. In the decribed embodiment, a metal object similar (but heavier) than the objects 26 on turntable 24 is used for cover weight 145.

Figure 10:
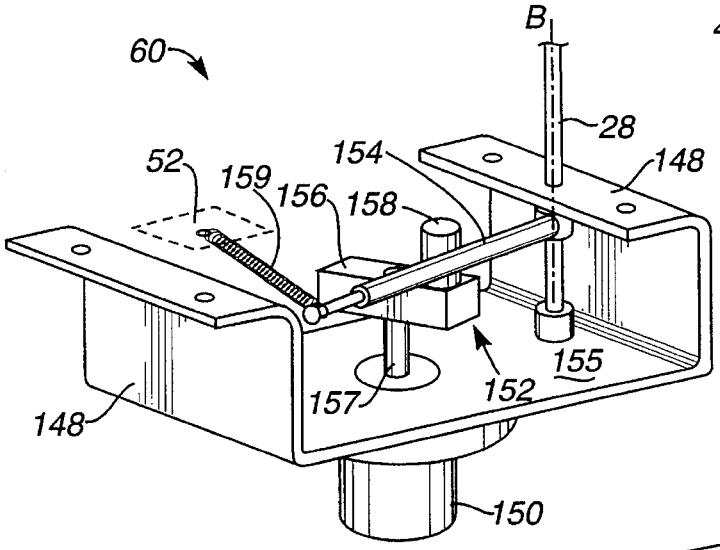
FIG. 10 is a perspective view of an arm drive mechanism of the present invention.

FIG. 10 is a perspective diagram of arm drive mechanism 60 as shown in FIG. 3. In the described embodiment, arm drive mechanism 60 includes a support plate 148, an arm motor 150, a rotating member 152, and a pivot rod 154. Support plate 148 is coupled to the bottom side of lower plane member 52 as shown in FIG. 3. Arm motor 150 is coupled to the bottom of support plate 148 and includes a rotating shaft 157 which is coupled to rotating member 152. Rotating member 152 includes a horizontal member 156 which is coupled to rotating shaft 157 and a push member 158 which is coupled to horizontal member 156.

Arm member 28 is rotationally coupled to support plate 148 and is also coupled to pivot rod 154. Pivot rod 154 is positioned such that push member 158 and rod 154 are at the same distance from floor 155 of plate 148. When arm motor 150 is activated, rotating shaft 157 rotates push member 158, and push member 158 pivots pivot rod 154 about its axis of rotation B. Pivot rod 158, in turn, pivots arm member 28 about axis B, which moves the tip of the arm member along arc 44 over the turntable, as shown in FIG. 2. A spring member 159 is coupled to the pivot rod 154 and is attached at its other end to lower plane member 52 by a screw or other fastener. The spring member is operative to force arm member 28 back to its starting position near inner edge 38 after a game is over. Thus, once arm motor is not activated, shaft 157 can rotate freely, and spring member 159 forces the pivot rod in the opposite direction.

A player pushes the play button 20 on front panel 12 to activate the arm motor 150. In the described embodiment, the motor moves arm member 28 across turntable 24 in a continuous, single sweep after play button 20 has been pushed. Thus, the player has to examine the turntable to see if an object he or she desires is coming close to the arm member 28. The player pushes the button and the arm member sweeps across the table, perhaps pushing the desired object to the collection pocket. The arm member 28 ends its movement at the outer edge 44 of the turntable. Once it ends its movement, the microprocessor allows the arm member to move back to its starting position near the inner edge 38 of the turntable by deactivating the motor; the arm is thus positioned to be used when another game starts.

In an alternate embodiment, arm motor 150 can be implemented to pivot arm member 28 only when play button 20 is being pushed. A player could thus try to push a desired object from the turntable by holding down play button 20. If he missed the desired object, however, he could release play button 20, halting the movement of the arm member. If the tip 144 of arm member 28 was still some distance away from the outer edge 44, then a new, different object near the outer edge (or the same object as it rotates around again) could be spotted and the player could push the button again to attempt to guide the new object into the collection pocket.

Figure 11:
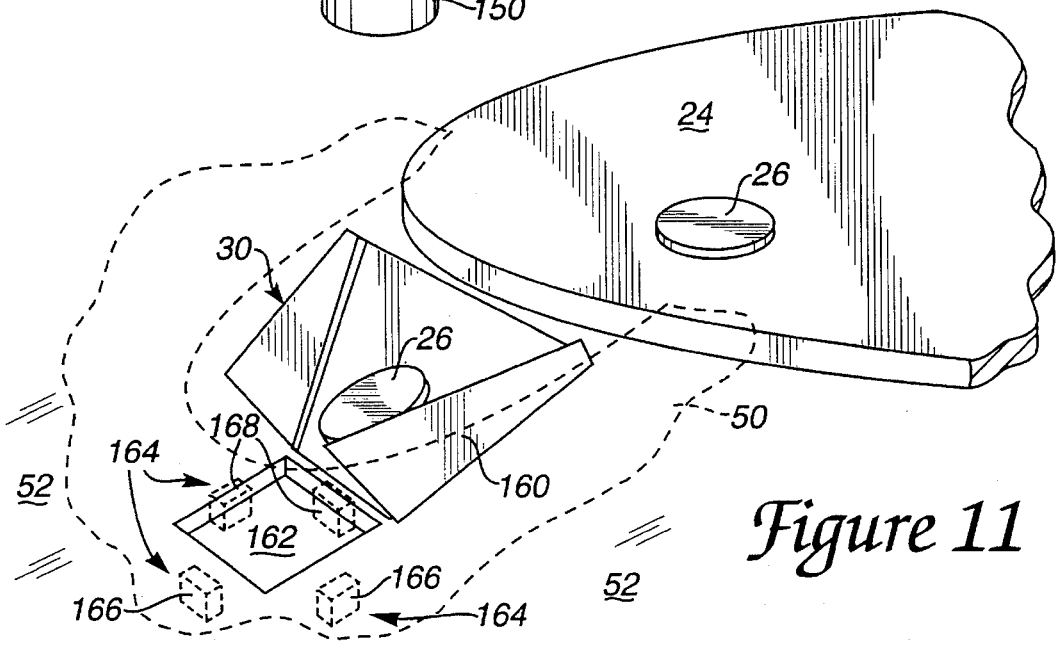
FIG. 11 is a perspective view of a collection pocket of the present invention.

FIG. 11 is a perspective view of a portion of turntable 24 located near a collection pocket 30. Collection pocket 30 includes a guide 160, an aperture 162, and sensors 164. Guide 160 is positioned on lower plane member 52 just underneath turntable 24 such that any objects 26 which are pushed into collection pocket 30 will fall onto guide 160. Objects landing on guide 160 are guided to aperture 162 in lower plane member 52. A chute (not shown) is positioned just underneath aperture 162 to receive objects 26 and route the objects to dispensing aperture 22 in front panel 12, where the player can pick up the objects.

Sensors 164 are positioned on the bottom surface of lower plane member 52 around aperture 162 in the described embodiment. Preferably, a sensor 164 includes an emitter 166 and an opposing detector 168. In the described embodiment, two emitters 166 and two detectors 168 are positioned 90 degrees apart around aperture 162. Similar to the sensor 94 of dispenser 34 described above with reference to FIG. **5*b*, emitters 166 preferably transmit a beam of electromagnetic energy, such as infrared light, across aperture 162 to an opposing detector 168, which continually receives and detects the beam. When an object 26 falls through aperture 126, it breaks one or both beams projected from emitters 166, and one or both detectors 168 sense that a beam has been broken. A detector 168 sends a signal to a control system (described below) indicating that a beam has been broken. A different number of sensors can be used in other embodiments depending on the shape and size of the object 26 being used. For example, if an object 26 is flat in more than one dimension (e.g., small rods or sticks), more emitters 166 and detectors 168 may be needed to reliably detect the object when it fails through aperture 162**.

In other embodiments, different types of sensors can be used. For example, a Hall effect switch can be used, which can sense metallic materials (as used in a coin) using a magnetic apparatus. In other embodiments, if a heavy object is guided onto guide 160, a switch positioned on guide 160 can detect the passage of the object if the object contacts the switch.

Sensors 164, as described above, may occasionally detect only one object that has fallen in aperture 162 when, in actuality, two or more objects may have fallen in. This can occur when, for example, two objects fall into aperture 162 simultaneously and simultaneously break the sensor beams emitted from emitters 166. Thus, the number of objects which have been guided off of turntable 24 may not exactly be known by the microprocessor of the control system; typically, the number of objects known by the microprocessor can be greater than the actual number of objects still situated on turntable 24 after several objects have been guided off by players. To compensate for this possibility and keep the number of objects on the turntable relatively constant, the control system can be programmed to cause dispenser 34 to dispense a predetermined number of objects after a predetermined length of game time has expired, or after a predetermined number of games have been played. For example, an extra object 26 can be dispensed after every ten games played.

Figure 12:
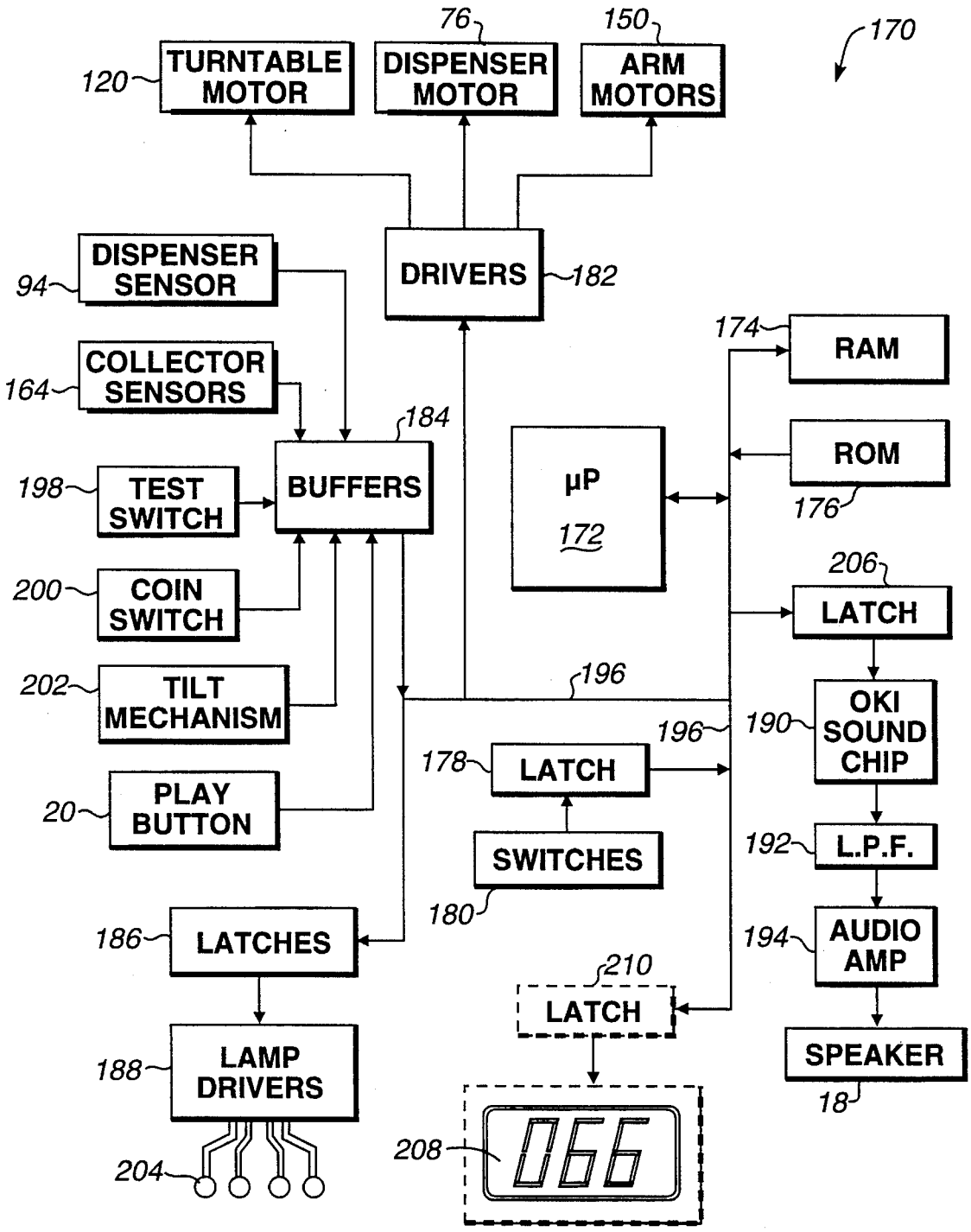
FIG. 12 is a block diagram of a control system for the game apparatus of the present invention.

FIG. 12 is a block diagram of a control system 170 of game apparatus 10. The control system, for example, can be implemented on one or more printed circuit boards which can be located on member 68 under lower plane member 52 of game apparatus 10, as shown in FIG. 3. The components of control system 170 include a microprocessor 172, RAM 174, ROM 176, a latch 178, DIP switches 180, drivers 182, buffers 184, latches 186, lamp drivers 188, sound chip 190, low pass filter 192, audio amplifier 194, and speaker 18.

The microprocessor 172 is preferably an 8-bit microprocessor, such as the Intel 8031, which has the range of features adequate for the task, including eight data lines and sixteen address lines. The microprocessor 172 is coupled to ROM 176 by a data/address/control bus 196. The ROM 176 is preferably an erasable, programmable read-only memory (EPROM) that contains the start-up instructions and operating system for the microprocessor 172. Microprocessor 172 is connected to RAM 174 by bus 196 to permit the use of RAM for scratch-pad memory. Methods for coupling ROM 176 and RAM 174 to the microprocessor 172 by bus 196 including enable, address, and control lines are well-known to those skilled in the art.

The microprocessor 172 is also coupled to a latch 178 by the bus 196. The switches 180 coupled to latch 178 provide selectable functions that the operator of the game unit may change to his or her liking. These selectable functions include the speed of arm members 28 as they are pivoted across turntable 24, the manner of operation of arm members 28 (i.e., if the arm members are moved in a single, continuous movement or are moved only when play button 20 is pressed), and the speed of rotation of the turntable 24. These factors can affect the difficulty of the game to make objects easier or more difficult to obtain; if more expensive objects are displayed on turntable 24, then the operator may desire to increase the difficulty of the game. Other functions selectable by switches 180 include sound effects, the test mode, the type of game, and so on, depending on how many selectable functions are desired. Switches 180 can, for example, be implemented as DIP switches. Alternatively, the functions selected by switches 180 can be selected from another input device, such as a control panel of buttons, etc.

The microprocessor 172 is also coupled to drivers 182 and buffers 184. The buffers 184 receive data from several switches and sensors, including test switch 198, which activates a test mode for the game apparatus 10 to determine if the game is operating correctly; coin switch 200, which is closed when a coin has been inserted into the coin slot 16 of the front panel 12; and tilt mechanism 202, which detects if the game apparatus 10 has been tilted too far to one side by a player, and is well known to those skilled in the art. Also providing input to buffers 184 is dispenser sensor 94 which detects if an object 26 has been dispensed and is detailed with respect to FIG. 5*b;* and collector sensors 164, which detect if an object falls into a collector pocket 30 and are detailed with respect to FIG. 11.

Drivers 182 activate output devices including turntable motor 120 for rotating turntable 24, dispenser motor 76 for dispensing an object from dispenser 34, and arm motors 150, which move arm members 28 across the surface of turntable 24.

The microprocessor 172 is also coupled to latches 186 which latch data for the lamp drivers 188. The lamp drivers 102 supply power to the lamps 204, which include lights around the perimeter of turntable 24, front panel 12, collection pockets 30, and other similar areas which can be highlighted as part of game action. In the preferred embodiment, components such as the motors 120, 76, and 150 and lamps 122 are powered by a commercially available 110 V AC power supply and power converters, which are well known in the art.

The microprocessor 172 is also coupled to a sound chip 190 which can be, for example, an OKI Voice Synthesis LSI chip available from OKI Semiconductor of San Jose, Calif. that has eight data input lines coupled to the microprocessor 172 by a latch 206. The sound chip 190 can receive its data from ROMs (not shown) and preferably outputs sound data to a low pass filter 192, an audio power amplifier 194, and finally to the output speaker 18, which generates sounds to the player playing the game apparatus 10, as is well known to those skilled in the art.

In some embodiments which calculate and display a game score, the microprocessor 172 can also be coupled to game score display 208. The bus 196 connecting the microprocessor 172 to the score display 208 is latched by a latch 210. The game score display can be a 7-segment LED digit display or similar display.

The preferred embodiment of the control system 172 operates briefly as follows. The microprocessor 172 first reads the low memory from ROM 176 over bus 196 and sequences through the software instructions stored in ROM. The settings of DIP switches in the switches block 180 are also read into the microprocessor. The software from the ROM 176 then instructs the microprocessor 172 to send and receive data over the bus 196 in order to conduct a game. For example, when the coin switch 200 is activated, indicating a coin has been inserted into coin slot 16, the microprocessor receives a signal from the buffers 184 on bus 196. The microprocessor also receives a signal when play button 20 is pushed by the player. The microprocessor sends signals to the drivers 182 over bus 196 to control the motors of the game apparatus as appropriate to game action. The microprocessor reads buffers 184 to determine if collector sensors 164 have sensed any objects failing into collection pocket 30. Once the game is over, the microprocessor awaits another signal from coin switch 200 indicating another coin has been deposited in coin slot 16. During game play, the microprocessor sends appropriate output signals over bus 196 to activate speaker 18 and lamps 204 whenever game action occurs, such as when arm member 28 is moved or an object fails into a collection pocket. The microprocessor can also send signals to update game score display 208 if present. The operation of the preferred embodiment of the game apparatus is described in greater detail with respect to FIG. 13.

Figure 13:
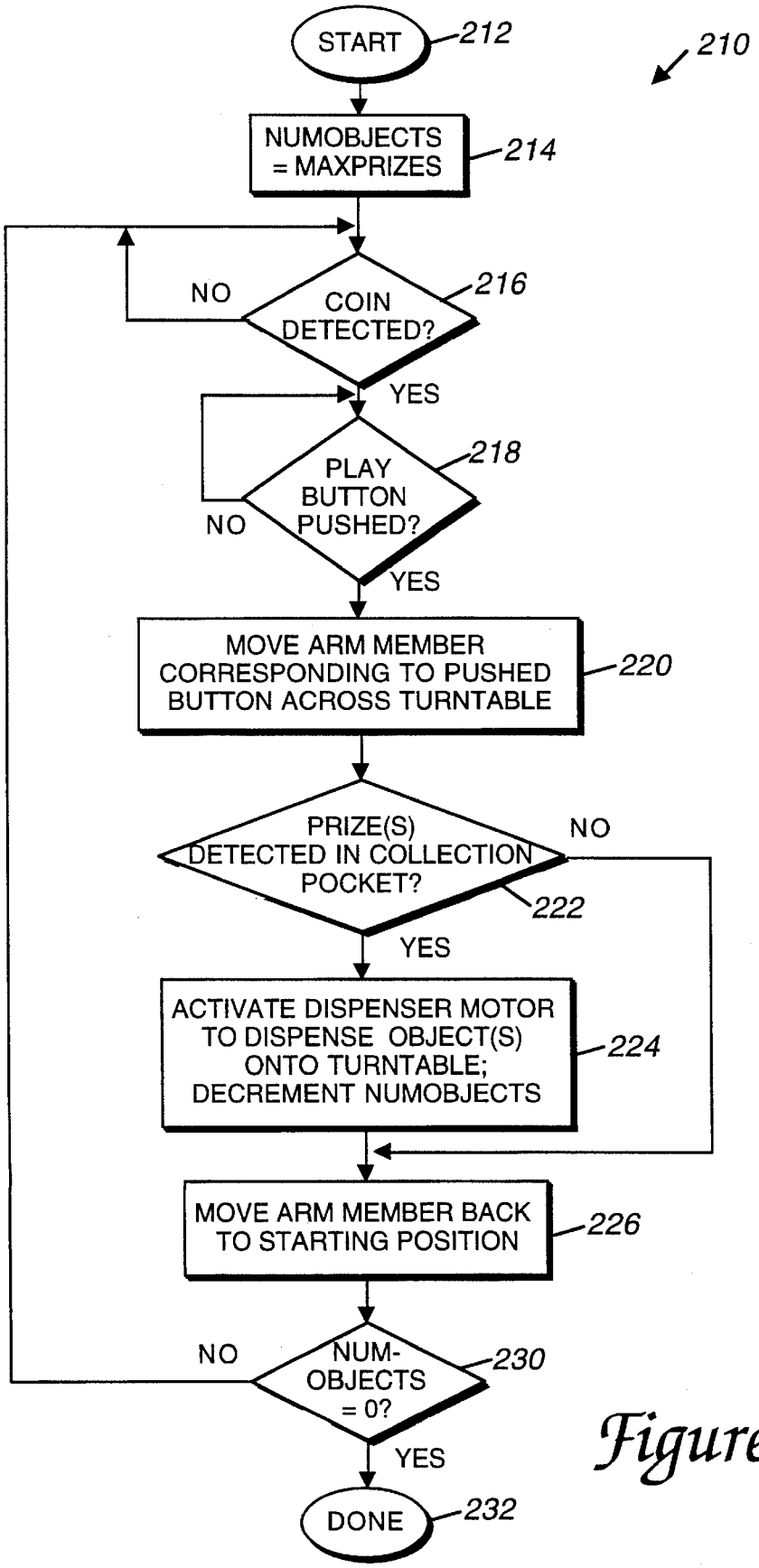
FIG. 13 is a flow diagram illustrating the process of operating and playing the game apparatus of the present invention.

FIG. 13 is a flow diagram illustrating a method 210 of operating and playing game apparatus 10. The method described in FIG. 13 applies to a single player position of game apparatus 10, i.e., a single coin slot, associated play button, arm member, collection pocket, and dispensing aperture for one player. This method can be implemented separately and/or at offset times for all the available player stations of game apparatus 10. The process begins at 212. At 212, it is assumed that game apparatus 10 has been set up to play, i.e., objects 26 have been scattered (e.g., manually) on the surface of turntable 24 to provide an even concentration of objects over the surface, dispenser 34 has been filled with the maximum number of objects 26, and turntable 24 is rotating by activation of turntable motor 120 of drive wheel assembly 56*b*. In step 214, the variable NUMOBJECTS, as stored by microprocessor 172, is set equal to the maximum number of prize objects 26 which can be displayed and dispensed in the game without an operator having to add more objects. In the described embodiment, the NUMOBJECTS is equal to the maximum number of objects which can be loaded into dispenser 34 plus the number of objects initially placed on the surface of turntable 24 when the dispenser is loaded.

In next step 216, the microprocessor checks if a coin has been detected by checking input signals from coin switch 200. If no coin is detected, step 216 is repeated until a coin is detected. In step 218, the microprocessor checks if the play button 20 on front panel 12 has been pushed by the player. If not, then the microprocessor continues checking at step 218 until the play button has been pushed. In an alternate embodiment, the microprocessor can wait for a predetermined length of time for the play button to be pushed. If the button is not pushed within that time period, the game can be considered to be over, and the process returns to step 214.

In next step 220, the microprocessor moves the arm member 28 which corresponds to the pushed button across the turntable. For example, as shown in FIG. 2, if play button 20*a* is pressed, then arm member 28*a* is moved along arc 44. In step 222, the microprocessor checks if one or more objects have been detected in the collection pocket corresponding to the moved arm member, indicating that the player has successfully coordinated the movement of the arm member with the movement of one or more prize objects and has pushed the object(s) into the collection pocket. If not, the process continues to step 226, described below. If so, step 224 is initiated, in which the dispenser motor 76 is activated to dispense the same number of objects onto turntable 24 as was detected in the collection pocket. The microprocessor can count the number of objects collected using collector sensors 164 and the number of objects dispensed using dispenser sensor 94. Also, NUMOBJECTS is decremented in this step. If a game score display 208 is being used, the microprocessor can update the score display in accordance with the amount, shape, or other characteristics of the objects detected in collection pocket 30. An award dispenser, such as a ticket dispenser, can also be controlled to dispense an amount of awards to a player based on the game score.

In next step 226, the microprocessor moves the activated arm member back to its starting position near inner edge 38 as shown in FIG. 2 so that it will be ready for the next game. In the described embodiment, this is accomplished by deactivating arm motor 150 to allow spring member 159 to force arm member back to the starting position. In step 230, the microprocessor checks if NUMOBJECTS equal zero. If not, then there are still objects in dispenser 34 to be dispensed, and the process returns to step 214 to check for another coin to be deposited in coin slot 18. If NUMOBJECTS equals zero, then the dispenser 34 is empty and must be refilled with objects by the game operator. The process is thus complete as indicated at 232.

In the embodiment described above, turntable 24 is continuously being rotated from the beginning of the process at 210 until the end of the process at 232. Players can thus see the turntable and prize objects rotating before inserting a coin to play, even if no one is currently playing the game. However, in an alternate embodiment, turntable 24 can be rotated only after a coin is inserted and can be stopped from rotating when no players are currently playing game apparatus 10 by deactivating turntable motor 120.

While this invention has been described in terms of several preferred embodiments, it is contemplated that alterations, modifications and permutations thereof will become apparent to those skilled in the art upon a reading of the specification and study of the drawings. For example, other shapes and types of arm members 28 can be used to push objects into collection pockets. In addition, other types of arm moving mechanisms 60, dispensers 34 and turntable-edge driving mechanisms 56 can be used to suit particular applications. It is therefore intended that the following claims include all such alterations, modifications and permutations as fall within the spirit and scope of the present invention.

What is claimed is:

1. An arcade game apparatus comprising:

a rotating member having a surface and a central aperture, said rotating member being coupled to a support and including a turntable which is rotated about a central axis;

a movable arm member positioned above said rotating member and having a tip engageable with said surface of said rotating member, wherein said arm member can be moved to force an object off said rotating member by engaging said object with said arm member near said tip;

a collector positioned to receive said object when said object has been forced off of said rotating member; and an object dispenser for dispensing additional objects onto said surface of said rotating member through said central aperture of said rotating member, said object dispenser including an elongated tube or holding said objects, said tube having a pusher element for dispensing said objects onto said turntable.

2. A game apparatus as recited in claim 1 wherein said turntable includes a center, and wherein said game apparatus further comprises a turntable driving mechanism engaged with said turntable at a position away from said center of said turntable for causing said turntable to rotate.

3. A game apparatus as recited in claim 2 wherein said turntable driving mechanism includes a plurality of wheels positioned proximate to and supporting said outside edge of said turntable, said wheels being coupled to said support.

4. A game apparatus as recited in claim 3 wherein said turntable driving mechanism includes a motor, and wherein at least one of said wheels is rotated by said motor to rotate said turntable.

5. A game apparatus as recited in claim 3 wherein said end of said moveable arm member includes a tip cover which engages said turntable.

6. A game apparatus as recited in claim 5 wherein said tip cover is loosely attached to said end of said arm member such that when said tip cover loses material at a point of contact with said turntable, said tip cover slides down said end of said arm member to remain engaged with said turntable.

7. A game apparatus as recited in claim 6 wherein said moveable arm member is rotatably engaged with a support, wherein the movement of said arm member is constrained in an arc over said turntable.

8. A game apparatus as recited in claim 5 further comprising an arm motor coupled to said arm member for moving said arm member.

9. A game apparatus as recited in claim 8 wherein said arm member has a starting position near a center of said turntable, and is constrained in a direction towards said outer edge of said turntable.

10. A game apparatus as recited in claim 9 wherein said collection device includes a sensor for detecting when an object is moved off said turntable.

11. A game apparatus as recited in claim 1 wherein said objects include flat, substantially circular objects.

12. A game apparatus as recited in claim 1 further comprising a coin box.

13. An arcade game for moving and dispensing displayed objects comprising:

a turntable coupled to a support, said turntable including a central opening and being operative to rotate;

a plurality of prize objects positioned on an upper surface of said turntable, said objects being substantially flat;

a dispenser for dispensing said objects onto said turntable through said central opening in said turntable, said dispenser including an elongated tube having a pusher element for dispensing said objects onto said turntable:

an arm member coupled to said support and operative to move over said turntable, engage objects, and move said objects on said turntable when they are so engaged; and a turntable drive mechanism coupled proximate a periphery of said turntable for causing said turntable to rotate.

14. An arcade game as recited in claim 13 wherein said prize objects are substantially circular, flat objects.

15. An arcade game as recited in claim 14 wherein said prize objects are less than one-eight of an inch in height.

16. A game apparatus as recited in claim 13 wherein said object dispenser includes a sensor which detects the number of objects dispensed onto said turntable.

17. A game apparatus as recited in claim 16 wherein said object dispenser includes a guide operative to guide said prize objects onto said turntable such that said objects land in a predetermined orientation.

18. A game apparatus as recited in claim 16 wherein said arm member includes an end engaged with said turntable for pushing said objects to said desired location.

19. A game apparatus as recited in claim 16 further comprising a motor coupled to said arm member for pivoting said arm member, where said motor is operative to pivot said arm member in two directions.

20. A game apparatus as recited in claim 16 further comprising a collection pocket for collecting said prize objects and guiding said collected objects to a player.

21. A game apparatus as recited in claim 19 wherein said collection device includes a sensor for detecting when a prize object has been collected.

22. A game apparatus as recited in claim 20 wherein said turntable driving mechanism includes a plurality of wheel mechanisms supporting said outside edge of said turntable, said wheel mechanisms being coupled to said support.

23. A game apparatus as recited in claim 22 wherein said wheel mechanisms includes a motor, and wherein at least one of said wheel mechanisms is rotated by said motor to rotate said turntable.

24. A game apparatus as recited in claim 23 wherein said wheel mechanisms include a verticaly aligned wheel for supporting said turntable and a horizontally aligned wheel for preventing lateral movement of said turntable.

25. A method for playing a push game with flat objects, the method comprising the steps of:

(a) providing a rotating surface having a plurality of flat objects disposed thereupon;

(b) providing an arm member to engage with said rotating surface which can be pivoted in an arc over said rotating surface, wherein said arm member can push a first flat object on said rotating surface by engaging a tip of said arm member with said first flat object, such that said first flat object is moved off said rotating surface into a collector, wherein said tip includes a tip cover which engages said rotating surface and which is loosely attached to said end of said arm member such that when said tip cover loses material at a point of contact with said rotating surface, said tip cover slides down said end of said arm member to remain engaged with said rotating surface;

(c) providing said first flat object to a player from said collector; and (d) dispensing a second flat object onto said rotating surface from a center opening in said rotating surface when said first flat object is received by said collector.

26. A method as recited in claim 25 wherein said arm member is pivoted by a motor activated by a player.

27. A method as recited in claim 26 wherein said arm member pivots in one direction across said rotating surface from a start position to an end position when said motor is activated by said player.

28. A method as recited in claim 27 further comprising a step of pivoting said arm member in an opposite direction to said one direction back to said start position after said arm member is pivoted to said end position.

29. A method as recited in claim 25 further comprising a step of sensing said first flat object when said first flat object falls into said collector.

30. A method as recited in claim 29 wherein said step of dispensing said second flat object includes sensing said second flat object as it is dispensed.

31. A method as recited in claim 30 wherein said step of dispensing said second flat object includes dispensing said second flat object in a predetermined orientation.

32. A method as recited in claim 25 wherein said surface is rotated by engaging an outer edge of said surface with a wheel driven by a motor.

33. A method as recited in claim 25 wherein said step of dispensing said second flat object includes dispensing said second flat object from an elongated tube of a dispenser unit using a pusher element of said dispenser unit.

34. A game apparatus comprising:

a rotatable member having a play surface and provided with a central aperture;

means for supporting and rotating said rotatable member;

an arm positioned above said rotatable member, said arm having a tip engageable with said play surface, wherein said tip of said arm is loosely engaged with an end of a remainder of said arm such that said tip tends to remain in contact with said play surface due to the influence of gravity;

means for moving said arm such that said an object can be forced off said play by pushing said object with said tip of said arm;

collector means positioned to receive said object that has been forced off of said rotatable member; and object dispensing means for dispensing additional objects onto said play surface through said central aperture.

35. A game apparatus as recited in claim 34 wherein said rotatable member includes a disk-shaped turntable having a circumference and a central axis, said turntable being rotatable around said central axis, and wherein said means for supporting and rotating said rotatable member includes turntable driving means engaged with said turntable at a position away from said central axis.

36. A game apparatus as recited in claim 34 wherein said turntable driving means includes a motor having a shaft, and a drive wheel engaged with and rotated by said shaft, said drive wheel engaging said turntable proximate to said circumference.

37. A game apparatus as recited in claim 34 wherein said object dispensing means includes an elongated tube for holding said objects and pusher means associated with said tube for dispensing said objects onto said play surface.

38. A game apparatus as recited in claim 37 wherein said collector means includes sensor means for detecting when an object is moved off said play surface, said sensor means detecting objects along a plurality of directional axes.

39. A game apparatus as recited in claim 34 wherein said tip comprises a Teflon material.

40. A game apparatus as recited in claim 34 wherein said means for moving an arm includes motor means coupled to said arm.

41. A game apparatus as recited in claim 40 wherein said means for moving an arm includes a spring member for urging said arm towards a starting position in the absence of another force exerted on said arm to move said arm away from said starting position.

42. A game apparatus as recited in claim 34 wherein said objects include flat, disk-shaped objects.

43. A game apparatus as recited in claim 36 further comprising digital computer means for controlling said game apparatus.

44. A game apparatus as recited in claim 43 wherein a game play is controlled by a computer implemented process running on said digital computer means.

45. An arcade game apparatus comprising:

a rotating member having a surface and a central aperture, said rotating member being coupled to a support, said rotating member including a turntable which includes a center and is rotated about a central axis;

a turntable driving mechanism engaged with said turntable at a position away from said center of said turntable for causing said turntable to rotate, said turntable driving mechanism including a plurality of wheels positioned proximate to and supporting said outside edge of said turntable, said wheels being coupled to said support;

a movable arm member positioned above said rotating member and having a tip engageable with said surface of said rotating member, wherein said arm member can be moved to force an object off said rotating member by engaging said object with said arm member near said tip, said end of said moveable arm member including a tip cover which engages said turntable and which is loosely attached to said end of said arm member such that when said tip cover loses material at a point of contact with said turntable, said tip cover slides down said end of said arm member to remain engaged with said turntable;

a collector positioned to receive said object when said object has been forced off of said rotating member; and an object dispenser for dispensing additional objects onto said surface of said rotating member through said central aperture of said rotating member.

46. A game apparatus as recited in claim 45 wherein said moveable arm member is rotatably engaged with a support, wherein the movement of said arm member is constrained in an arc over said turntable.

47. A game apparatus comprising:

a rotatable member having a play surface and provided with a central aperture;

means for supporting and rotating said rotatable member;

an arm positioned above said rotatable member, said arm having a tip engageable with said play surface;

means for moving said arm such that said an object can be forced off said play by pushing said object with said tip of said arm;

collector means positioned to receive said object that has been forced off of said rotatable member; and object dispensing means for dispensing additional objects onto said play surface through said central aperture, said object dispensing means including an elongated tube for holding said objects and pusher means associated with said tube for dispensing said objects onto said play surface.

48. A game apparatus as recited in claim 47 wherein said collector means includes sensor means for detecting when an object is moved off said play surface, said sensor means detecting objects along a plurality of directional axes.

49. A game apparatus comprising:

a rotatable member having a play surface and provided with a central aperture;

means for supporting and rotating said rotatable member;

an arm positioned above said rotatable member, said arm having a tip engageable with said play surface;

means for moving said arm such that said an object can be forced off said play by pushing said object with said tip of said arm, said means for moving an arm including motor means coupled to said arm and a spring member for urging said arm towards a starting position in the absence of another force exerted on said arm to move said arm away from said starting position;

collector means positioned to receive said object that has been forced off of said rotatable member; and object dispensing means for dispensing additional objects onto said play surface through said central aperture.

* * * * *